US008134442B1

(12) United States Patent
Leupold

(10) Patent No.: US 8,134,442 B1
(45) Date of Patent: Mar. 13, 2012

(54) MAGIC SPHERES ASSEMBLED FROM CONICALLY MAGNETIZED RINGS

(75) Inventor: Herbert A. Leupold, Eatontown, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 12/931,634

(22) Filed: Jan. 31, 2011

(51) Int. Cl.
*H01F 7/02* (2006.01)

(52) U.S. Cl. ..... 335/306; 335/302

(58) Field of Classification Search ..... 335/210, 335/296–306; 336/229–231; 505/211–213
See application file for complete search history.

(56) References Cited

U.S. PATENT DOCUMENTS

| | | | | |
|---|---|---|---|---|
| 4,831,351 | A * | 5/1989 | Leupold et al. | 335/306 |
| 5,337,472 | A * | 8/1994 | Leupold et al. | 29/607 |
| 5,382,936 | A * | 1/1995 | Leupold et al. | 335/306 |
| 5,428,335 | A * | 6/1995 | Leupold et al. | 335/306 |
| 5,990,774 | A * | 11/1999 | Leupold | 335/306 |
| 6,680,663 | B1 * | 1/2004 | Lee et al. | 335/306 |
| 2004/0140875 | A1 * | 7/2004 | Strom | 335/306 |

* cited by examiner

*Primary Examiner* — Bernard Rojas
(74) *Attorney, Agent, or Firm* — Michael Zelenka; Stephen J. Harbulak

(57) ABSTRACT

A group of magnetic strands are configured into a minimal number of solid magnetized toroidal rings with a conical magnetization direction and then aligned, stacked and assembled into a magic sphere magnetic structure. Each magnetized toroidal ring has predetermined dimensions to form the inner and outer surfaces of a spherical shell. The present invention also encompasses a magic sphere magnetic device with unsegmented solid magnetized toroidal rings and methods for assembling a magic sphere by stacking magnetized toroidal rings with a conical magnetic direction.

14 Claims, 3 Drawing Sheets

MAGIC SPHERES ASSEMBLED FROM CONICALLY MAGNETIZED RINGS

GOVERNMENT INTEREST

The invention described herein may be manufactured, used, imported, sold, and licensed by or for the Government of the United States of America without the payment to me of any royalty thereon.

FIELD OF THE INVENTION

This present invention relates to magic sphere magnetic structures. More particularly, present invention relates to a magic sphere magnetic structure assembled from conically magnetized toroidal rings.

BACKGROUND OF THE INVENTION

One of the most useful permanent magnet structures is the hollow cylindrical flux source, or magic ring, which is a cylindrical permanent magnet shell that offers an interior magnetization vector that is more or less constant in magnitude throughout the interior cavity of the structure and produces a magnetic field greater than the remanence of the magnetic material from which it is made. The magic ring, also know as a magic cylinder or Halbach cylinder, produces comparatively high transverse fields in a cylindrical cavity which it encloses in the form of a cylindrical shell. They are well known and discussed in numerous publications and papers such as *Rare Earth Iron Permanent Magnets*, edited by J M D Coey, Oxford Science Publications (1996) and U.S. Pat. Nos. 5,382,936 and 5,428,335, both entitled "Field Augmented Permanent Magnet Structures," in which this inventor was a co-inventor. FIG. 1 is a cross-sectional view of an abbreviated prior art magic ring magnetic structure, with 8 wedge-shaped pieces, the small arrows indicating magnetization direction of each wedge-shaped piece and the large central arrow indicating the magnetic field direction. FIG. 1 also illustrates the angles $\theta$ and $\gamma$. The magic ring can be also approximated by assembling transversely magnetized rods that are circularly arranged about a central cylindrical space.

If a transverse section of a magic cylinder is rotated about its polar axis its locus forms a magic sphere. FIG. 2 is a cross-sectional view of a prior art magic sphere magnetic structure with the small arrows indicating magnetization direction of each one of the numerous pieces assembled to form the prior art structure.

While the prior art magic ring and magic sphere structures each have a number of useful features and applications, they all suffer from one chronic disadvantage. The disadvantage with these magnetic structures is that they all require the painstaking assembly of numerous pieces with different magnetic orientations. For example, the magic sphere disclosed in Leupold U.S. Pat. No. 5,382,936 "Field Augmented Permanent Magnet Structures," typically requires the assembly of at least 64 pieces with numerous magnetic orientations. Similarly, the magic ring typically requires assembly of as many as 26 different pieces with differing magnetic orientations. Such detailed fabrication and assembly requirements quickly lead to high manufacturing and assembly costs, as well as significant amounts of scrap material. For these reasons, there has been a need to assemble magic ring or magic sphere magnetic structures in a way that requires fewer piece parts, less assembly time and decreased manufacturing costs. Up until now, this need has not been answered.

SUMMARY OF THE INVENTION

In order to answer the need for assembling magic ring and magic sphere magnetic structures with fewer piece parts, less assembly time and decreased manufacturing costs without suffering from the disadvantages, drawbacks and shortcomings of prior art magnetic structures, the present invention provides a relatively small number of magnetized toroidal rings with a conical magnetization direction that are stacked and assembled into a magic sphere magnetic structure. In prior art structures, these magic rings are composed of many small segments, but in this invention each magnetized toroidal ring is in one single, solid piece. Referring now to the drawings, FIG. 3A depicts a simplified top view of a prior art magic ring composed of many small pieces while, FIG. 3B depicts a simplified top view of a single, solid magnetized toroidal ring 10 in accordance with the present invention.

Accordingly, it is an object of the present invention to provide a simpler, less costly and easier to assemble magic sphere magnetic device.

It is another object of the present invention to provide a simpler, less costly and easier to assemble magic sphere magnetic device with a group of magnetized toroidal rings having different dimensions and a conical magnetic field direction.

It is still a further object of the present invention to provide a simpler, less costly and easier to assemble magic sphere magnetic device with magnetized toroidal rings with different dimensions and conical magnetic field direction by stacking the magnetized toroidal rings.

These and other objects and advantages are accomplished by this invention's magic sphere device assembled by stacking magnetized toroidal rings with different dimensions and a conical magnetic field direction into a magic sphere configuration. In accordance with the present invention, magnetic strands are magnetized toroidally then stacked coaxially, or coiled, in a beehive-like fashion to provide a magic sphere magnetic structure that can be assembled with far fewer piece parts than prior art magic spheres and provide this invention's magic sphere structure. This invention's objects and advantages are achieved by fabricating each of the magnetized toroidal rings with predetermined dimensions to form the inner and outer surfaces of a spherical shell. This invention's magic sphere device assembled from magnetized toroidal rings answers the need for assembling magic spheres in a simpler and less costly way with fewer piece parts, less assembly time and decreased manufacturing costs. The present invention also encompasses methods for assembling a magic sphere by stacking magnetized toroidal rings with a conical magnetic direction.

DETAILED DESCRIPTION OF THE DRAWINGS

This invention's magic sphere device is assembled from magnetic strands that have been magnetized in a means for toroidal magnetization into magnetized toroidal rings. In accordance with the present invention, the magnetized toroidal rings, each having a conical magnetization direction, are stacked in a beehive-like fashion to provide a magic sphere magnetic structure. By assembling this invention's magic sphere from stacked magnetized toroidal rings, the magic sphere magnetic structure can be assembled with far fewer piece parts than prior art magic spheres yet still provide all of the advantages of the magic sphere.

Figure 3A:
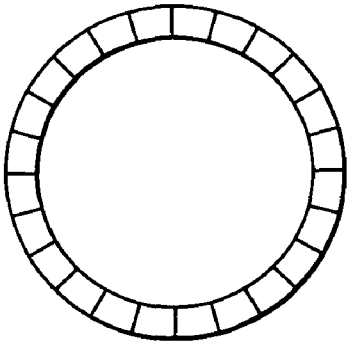
FIG.3A PRIOR ART
FIG. 3A depicts prior art magic sphere azimuthal segments.
Figure 3B:
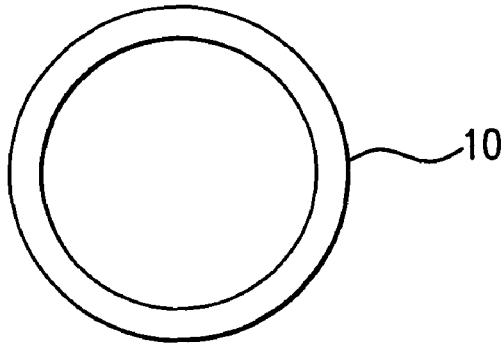
FIG. 3B depicts a magnetized toroidal ring in accordance with this invention.
Figure 4:
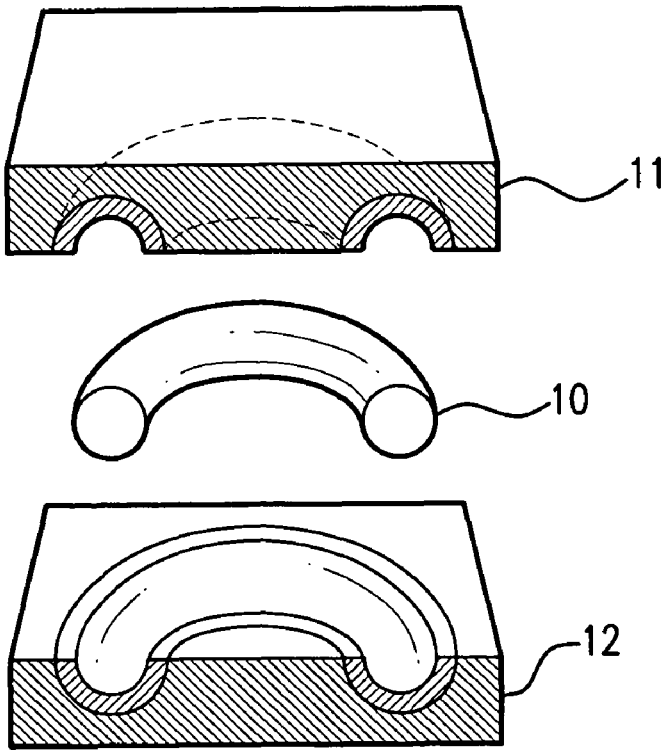
FIG. 4 depicts one example of means for toroidal magnetization that may be used to form this invention's magnetized toroidal rings.

In accordance with the present invention, magnetic strands are converted into magnetized toroidal rings by a means for toroidal magnetization and then stacked to form a magic sphere structure. Referring now to the drawings, FIG. 4 is one example of a toroidal magnetization means from this inventor's U.S. Pat. No. 4,911,627, entitled "Apparatus For Fabrication Of Permanent Magnet Toroidal Rings," which is incorporated herein by reference. This example of the toroidal magnetization means comprises an upper segment 11 and a lower segment 12. When the magnetic strand 10, shown here in cross-section, is deposited into the toroidal magnetization means and bent into a toroid at an angle with respect to the vertical or horizontal planes, then the magnetization direction will be at an angle with respect to the toroidal axis and provide the FIG. 3B magnetized toroidal ring 10 with a selected, angled, or conical interior magnetic field.

Figure 1:
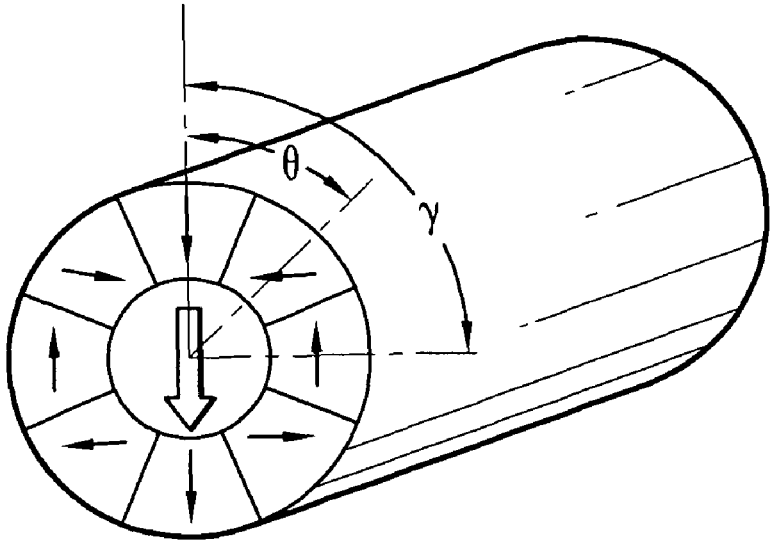
FIG. 1 PRIOR ART
FIG. 1 is a cross-sectional view of a prior art magic cylinder magnetic structure.
Figure 2:
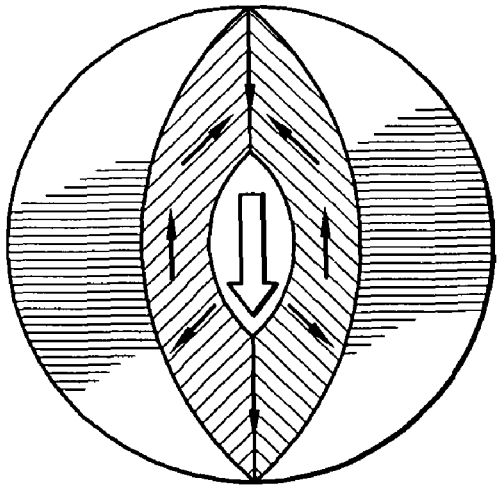
FIG. 2 PRIOR ART
FIG. 2 is a cross-sectional view of a prior art magic sphere magnetic structure.
Figure 5:
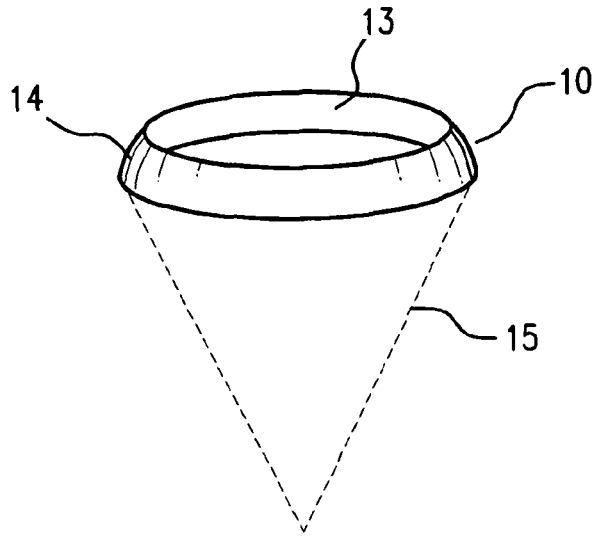
FIG. 5 is a perspective view of a single magnetized toroidal ring with a conical magnetic orientation following magnetization in a means for toroidal magnetization.

Each of this invention's magnetized toroidal rings has a conical magnetization whose cone angle varies according to this formula:

$$(\gamma=2\theta)$$

where $\theta$ is the polar angle of the magnetized toroidal ring's location in the magic sphere. This polar angle is illustrated in FIG. 1. This formula accounts for the greater strength achieved by each of this invention's toroidal rings following magnetization. FIG. 5 depicts a single toroidal magnetic ring 10 with a spherical inner surface 13, spherical outer surface 14, and a conical magnetic orientation indicated by the broken lines 15 projecting downward.

Figure 6:
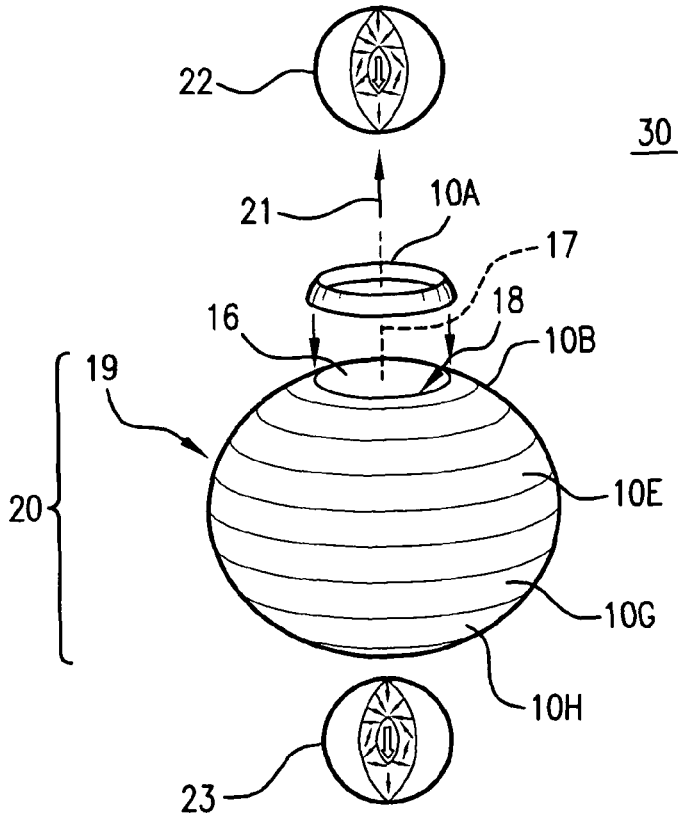
FIG. 6 is a perspective view of a magic sphere formed by arranging a group of stacked magnetized toroidal rings around a polar axis in accordance with the present invention.

FIG. 6 is a perspective view of this invention's a magic sphere 30 formed by arranging a group of differently-dimensioned magnetized toroidal rings 10A-10H stacked coaxially around a hollow central cavity 16 and a spherical polar axis 17. The magnetized toroidal rings 10A-10H are stacked coaxially around the polar axis 17 with each magnetized toroidal ring having a predetermined circumference and forming an inner shell surface 18 and an outer shell surface 19 of the shell 20 of the magic sphere 30. This invention's easier-to-assemble magic sphere 30 provides a vertical magnetic field along the spherical polar axis 17, which is represented by the arrow 21. The magnetized toroidal rings 10A-10H are positioned along parallels of latitude of the magic sphere 30. By magnetizing the magnetic strands in a means for toroidal magnetization according to the ($\gamma=2\theta$) formula, this invention's advantageous magic sphere structure is composed of a minimal number of unsegmented toroidal magnetic rings with conical, or angled, magnetic field orientation. The magic sphere device is completed with smaller top and bottom magic spheres, 22 and 23, respectively, which bypass the toroidal magnetization means because they will retain their spherical shape and are positioned at the top and bottom of the stacked magnetized toroidal rings 10A-10H. The spherical outer surface of the magnetized toroidal ring 10A in FIG. 6 is slightly exaggerated in that drawing to emphasize that each magnetized toroidal ring 10A-10H needs to have that type of outer surface in order to form the spherical shell 20 when the rings 10A-10H are stacked.

When each of the magnetized toroidal rings 10A-10H and magic spheres 22 and 23 maintain their given internal horizontal or vertical magnetic orientations, and the magnetized toroidal rings 10A-10H are shaped to have the appropriate spherical inner and outer surfaces 13 and 14, rather than being of simple circular cross section, then the magic sphere can be made as exact, or ideal, as desired by using a sufficient number of magnetized toroidal rings so as to approach a continuous change in field direction with change in $\theta$.

A number of variations are considered to be within the contemplation of this invention, such as assembling the magic sphere 30 with a sufficient number of unsegmented magnetic pieces so as to approach a continuous change in the vertical magnetic field direction with a change in the angle $\theta$, and the sufficient number being at least eight or ten magnetic pieces. However, the number of magnetic pieces may be varied according to the designer's requirements. The present invention also encompasses a magic sphere magnetic device with unsegmented solid magnetized toroidal rings and many of the same variations apply to this embodiment.

The present invention also encompasses a method for assembling a magic sphere magnetic structure by stacking a group of magnetized toroidal rings, comprising the steps of forming a group of magnetic strands; dimensioning each of the group of magnetic strands with a different predetermined circumference; inserting the magnetic strands into a means for toroidal magnetization; forming a plurality of solid magnetized toroidal rings with each solid magnetized toroidal ring having a spherical inner surface, a spherical outer surface, and being magnetized with a different conical magnetization direction; coaxially aligning and stacking an upper magic sphere, the plurality of solid, magnetized toroidal rings, and a lower magic sphere around a spherical polar axis; and thereby providing a spherical shell. The method continues with the steps of forming the spherical shell with an inner shell surface, an outer shell surface, and a hollow central cavity; locating the spherical polar axis within the hollow central cavity; and generating a strong vertical magnetic field along the spherical polar axis with a minimal number of solid, magnetized toroidal rings in combination with the different conical magnetization directions. Many of the variations that are applicable to the other embodiments also apply to this invention's methods.

It is to be further understood that other features and modifications to the foregoing detailed description are within the contemplation of the present invention, which is not limited by this detailed description. Those skilled in the art will readily appreciate that any number of configurations of the present invention and numerous modifications and combinations of materials, components, arrangements and dimensions can achieve the results described herein, without departing from the spirit and scope of this invention. Accordingly, the present invention should not be limited by the foregoing description, but only by the appended claims.

What I claim is:

1. A magic sphere magnetic structure, comprising:

a group of magnetic strands are dimensioned with a series of different predetermined circumferences;

said group of magnetic strands being toroidally magnetized into a plurality of solid, magnetized toroidal rings with a means for toroidal magnetization;

each of said plurality of magnetized toroidal rings, having a spherical inner surface and a spherical pouter surface, being magnetized with a different conical magnetization direction;

said plurality of magnetized toroidal rings along with an upper magic sphere and a lower magic sphere being coaxially aligned and stacked around a spherical polar axis to provide a spherical shell;

said spherical shell having an inner shell surface, an outer shell surface, and a hollow central cavity, with said spherical polar axis being located within said hollow central cavity; and said plurality of magnetized toroidal rings in combination with said different conical magnetization directions generate a strong vertical magnetic field direction along said spherical polar axis with a minimal number of said plurality of magnetized toroidal rings.

2. The magic sphere magnetic structure, as recited in claim 1, further comprising said plurality of magnetized toroidal rings being positioned along parallels of latitude of said magic sphere structure.

3. The magic sphere magnetic sphere structure, as recited in claim 2, further comprising each of said plurality of magnetized toroidal rings having a varying conical angle.

4. The magic sphere magnetic structure, as recited in claim 3, further comprising said varying conical angle varies according to the formula:

$$(\gamma=2\theta)$$

where said θ is the polar angle of the location of a given one of said plurality of magnetized toroidal rings in said magic sphere structure.

5. The magic sphere magnetic structure, as recited in claim 4, further comprising said spherical shell being composed of a sufficient number of said plurality of magnetized toroidal rings so as to approach a continuous change in said vertical magnetic field direction with a change in said θ.

6. The magic sphere magnetic structure, as recited in claim 5, further comprising said sufficient number being at least ten of said plurality of magnetized toroidal rings.

7. The magic sphere magnetic structure, as recited in claim 6, further comprising said sufficient number being eight of said plurality of magnetized toroidal rings.

8. A magic sphere magnetic device with unsegmented solid magnetized toroidal rings, comprising:

a group of magnetic strands are dimensioned with a series of different predetermined circumferences;

said group of magnetic strands being toroidally magnetized into a plurality of solid, magnetized toroidal rings with a means for toroidal magnetization;

each of said plurality of magnetized toroidal rings, having a spherical inner surface and a spherical outer surface, being magnetized with a different conical magnetization direction;

said plurality of magnetized toroidal rings along with an upper magic sphere and a lower magic sphere being coaxially aligned and stacked around a spherical polar axis to provide a spherical shell;

said spherical shell having an inner shell surface, an outer shell surface, and a hollow central cavity, with said spherical polar axis being located within said hollow central cavity; and said plurality of magnetized toroidal rings in combination with said different conical magnetization directions generate a strong vertical magnetic field direction along said spherical polar axis with a minimal number of said plurality of magnetized toroidal rings.

9. The magic sphere magnetic device with unsegmented solid magnetized toroidal rings, as recited in claim 8, further comprising said plurality of magnetized toroidal rings being positioned along parallels of latitude of said magic sphere structure.

10. The magic sphere magnetic device with unsegmented solid magnetized toroidal rings, as recited in claim 9, further comprising each of said plurality of magnetized toroidal rings having a varying conical angle.

11. The magic sphere magnetic device with unsegmented solid magnetized toroidal rings, as recited in claim 10, further comprising said varying conical angle varies according to this formula:

$$(\gamma=2\theta)$$

where said θ is the polar angle of the location of a given one of said plurality of magnetized toroidal rings in said magic sphere structure.

12. The magic sphere magnetic device with unsegmented solid magnetized toroidal rings, as recited in claim 11, further comprising said spherical shell being composed of a sufficient number of said plurality of magnetized toroidal rings so as to approach a continuous change in said vertical magnetic field direction with a change in said θ.

13. The magic sphere magnetic device with unsegmented solid magnetized toroidal rings, as recited in claim 12, further comprising said sufficient number being at least ten of said plurality of magnetized toroidal rings.

14. The unsegmented magic sphere magnetic device, as recited in claim 13, further comprising said sufficient number being eight of said plurality of magnetized toroidal rings.

* * * * *